US011357317B2

(12) United States Patent
Lu

(10) Patent No.: US 11,357,317 B2
(45) Date of Patent: Jun. 14, 2022

(54) TOOTHBRUSH STRUCTURE CAPABLE OF EXPANDING CLEANING DEPTH

(71) Applicant: Chien-Chou Lu, Changhua (TW)

(72) Inventor: Chien-Chou Lu, Changhua (TW)

( * ) Notice: Subject to any disclaimer, the term of this patent is extended or adjusted under 35 U.S.C. 154(b) by 88 days.

(21) Appl. No.: 16/994,856

(22) Filed: Aug. 17, 2020

(65) Prior Publication Data

US 2022/0015532 A1 Jan. 20, 2022

(30) Foreign Application Priority Data

Jul. 16, 2020 (TW) ..... 109209233

(51) Int. Cl.
*A46B 9/04* (2006.01)
*A46B 7/04* (2006.01)

(52) U.S. Cl.
CPC ..... *A46B 9/04* (2013.01); *A46B 7/044* (2013.01); *A46B 2200/1066* (2013.01)

(58) Field of Classification Search
None
See application file for complete search history.

(56) References Cited

U.S. PATENT DOCUMENTS 5,274,870 A * 1/1994 Stollman ..... A46B 7/06 15/22.1
6,192,544 B1 * 2/2001 Persidsky ..... A46B 17/08 15/167.1
7,213,293 B1 * 5/2007 Schraga ..... A46B 9/10 15/167.1
2001/0007624 A1 * 7/2001 Micaletti ..... A46B 11/0037 401/179
2003/0163882 A1 * 9/2003 Blaustein ..... A46B 13/008 15/22.2
2013/0061413 A1 * 3/2013 Li ..... A46B 11/0055 15/167.1
2017/0150808 A1 * 6/2017 Xi ..... A46B 5/02
2018/0125219 A1 * 5/2018 Kayser ..... A46B 15/0081
2018/0255917 A1 * 9/2018 Sainudeen ..... A46B 15/0087

* cited by examiner

*Primary Examiner* — Joseph J Hail
*Assistant Examiner* — Dana Lee Poon
(74) *Attorney, Agent, or Firm* — Karin L. Williams; Alan D. Kamrath; Mayer & Williams PC

(57) ABSTRACT

A toothbrush structure contains: a body, a movable brush, and a protective unit. The body includes a handle, a connecting neck, and a fixed head. The connecting neck is connected with the handle and the fixed head, the fixed head has multiple first orifices for receiving multiple first bristles, and a slot is formed on the fixed head and extends to the handle. The movable brush slides in the slot linearly and includes a push block, a slidable post, and a movable brushing portion. The push block is disposed on the slidable post, and the movable brushing portion is mounted on the slidable post opposite to the push block and has multiple second orifices for receiving multiple second bristles. The slidable post is received in the slot. The protective unit is configured to cover the slot so that the movable brush is limited to slide in the slot.

8 Claims, 10 Drawing Sheets

Enlarged view of part A

Enlarged view of part B

Enlarged view of part C

D-D section view

E-E section view

TOOTHBRUSH STRUCTURE CAPABLE OF EXPANDING CLEANING DEPTH

FIELD OF THE INVENTION

The present invention relates to a toothbrush structure which contains the push block pushed by the user to extend the movable brush out of the body so that the movable brushing portion cleans an oral cavity and teeth and massage gums.

BACKGROUND OF THE INVENTION

A conventional toothbrush contains a handle, a head, and multiple bristles fixed on the head, wherein the multiple bristles are fixed at same or different heights so that the handle is gripped by a user and toothpaste is squeezed on the multiple bristles, then the head is extended into a mouth to brush the teeth back and forth, massage gums, and remove food residue from interdentals, thus avoiding tooth decay.

The multiple bristles are spaced and fixed on the head of the handle, so the head cannot extend into a deep portion of the oral cavity and clean the teeth at any angles freely.

Furthermore, wisdom teeth cannot be cleaned by the toothbrush effectively to maintain the food residue and to cause caries/tooth decay of the wisdom teeth and periodontal disease of the second molars easily.

The present invention has arisen to mitigate and/or obviate the afore-described disadvantages.

SUMMARY OF THE INVENTION

The primary aspect of the present invention is to provide a toothbrush structure which contains the push block pushed by the user to extend the movable brush out of the body so that the movable brushing portion cleans an oral cavity and teeth of the user at any angles freely.

Secondary aspect of the present invention is to provide a toothbrush structure which contains a reinforced structure to avoid deformation and to prolong a service life of the toothbrush structure after cleaning the oral cavity and the teeth for a period of using time.

Further aspect of the present invention is to provide a toothbrush structure which contains a movable brush, and the movable brush is replaceable after deformation to save using cost and obtain environmental protection.

Another aspect of the present invention is to provide a toothbrush structure which contains the connection portion sliding in the guide groove linearly and positioned by the multiple positioning portions, such that the movable brush is positioned by the multiple positioning portions after extending out of the guide groove in a predetermined distance.

To obtain above-mentioned aspects, a toothbrush structure provided by the present invention contains: a body, a movable brush, and a protective unit.

The body includes a handle, a connecting neck, and a fixed head. The handle is connected with the connecting neck and is configured to be gripped by a user. The connecting neck is connected with the handle and the fixed head, the fixed head has multiple first orifices for receiving multiple first bristles, and a slot is formed on a middle portion of the fixed head and extends to the handle.

The movable brush is accommodated and slides in the slot linearly, and the movable brush includes a push block, a slidable post, and a movable brushing portion. The push block is disposed on a top of a first end of the slidable post, the movable brushing portion is mounted on a second end of the slidable post opposite to the push block, and the movable brushing portion has multiple second orifices for receiving multiple second bristles. The slidable post is received in the slot to slide the movable brushing portion in the slot.

The protective unit is configured to cover the slot so that the movable brush is limited to slide in the slot.

Preferably, the handle of the body includes at least one anti-slip face defined thereon.

Preferably, a height of the connecting neck is lower than the handle and the fixed head so that two ends of the connecting neck have two stop faces, such that the movable brush is limited to slide in the slot.

Preferably, the movable brush includes an engagement tab formed thereon opposite to the movable brushing portion and configured to engage with the two stop faces.

Preferably, a connection portion is defined between the push block and the slidable post, and the protective unit includes multiple positioning portions and a guide groove. The connection portion slides in the guide groove linearly and is positioned by the multiple positioning portions, such that the movable brush is positioned by the multiple positioning portions after extending out of the guide groove in a predetermined distance.

Preferably, the slidable post has at least one reinforced rib formed on a side surface thereof.

Preferably, the body and the protective unit are connected in a high-frequency treatment manner.

Preferably, the body and the protective unit are connected by using an adhesive.

Preferably, the body is connected with the protective unit by way of a dovetail structure.

Accordingly, the movable brush extends out of the body so that the fixed head and the movable brushing portion are operated at any angles to clean the oral cavity and teeth of the user freely.

The movable brush is adjustably moveable with respect to the fixed head so as to clean the teeth and interdentals and to massage gums, thus preventing tooth decay.

The protective unit is detachable to replace the movable brushing portion after a period of using time, thus saving using cost and obtaining environmental protection.

The toothbrush structure is applicable for an adult toothbrush and a children toothbrush to clean teeth and interdentals and to avoid caries.

DETAILED DESCRIPTION OF THE PREFERRED EMBODIMENTS

Figure 1:
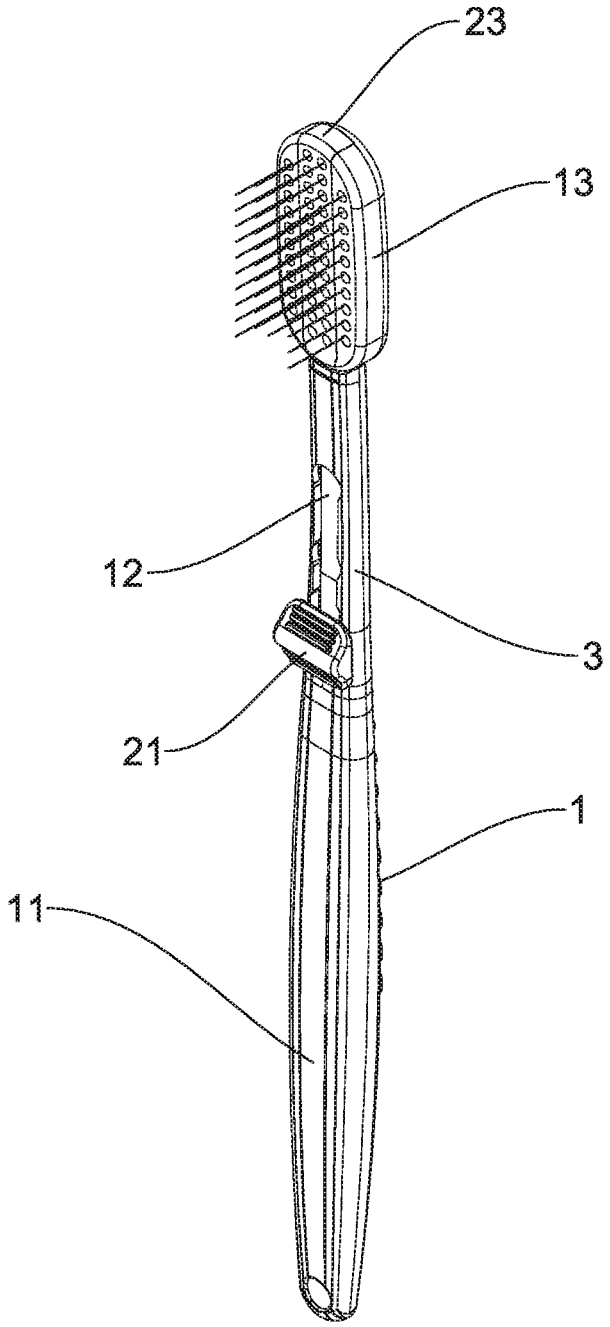
FIG. 1 is a perspective view showing the assembly of a toothbrush structure according to a preferred embodiment of the present invention.
Figure 2:
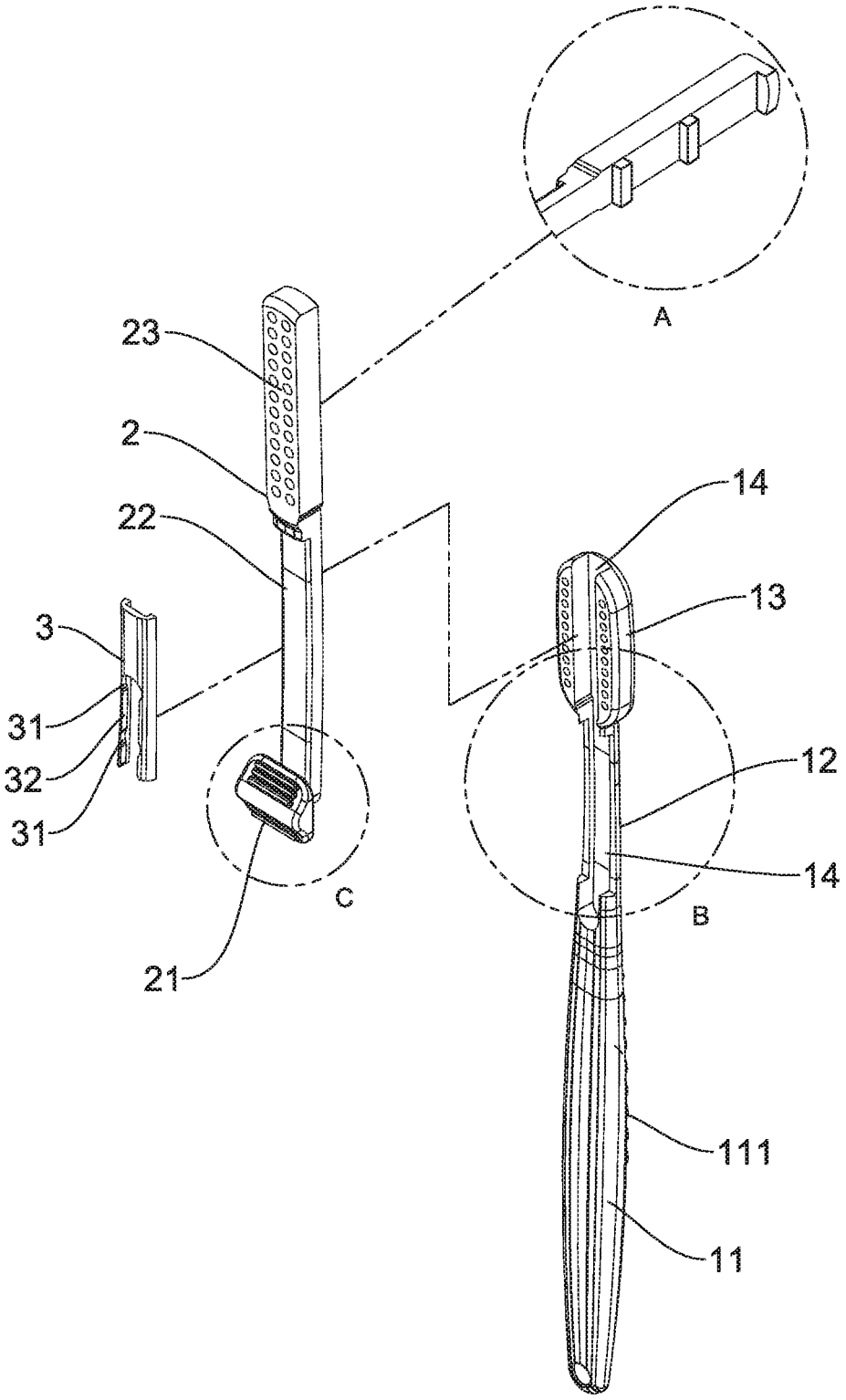
FIG. 2 is a perspective view showing the exploded components of the toothbrush structure according to the preferred embodiment of the present invention.
Figure 3:
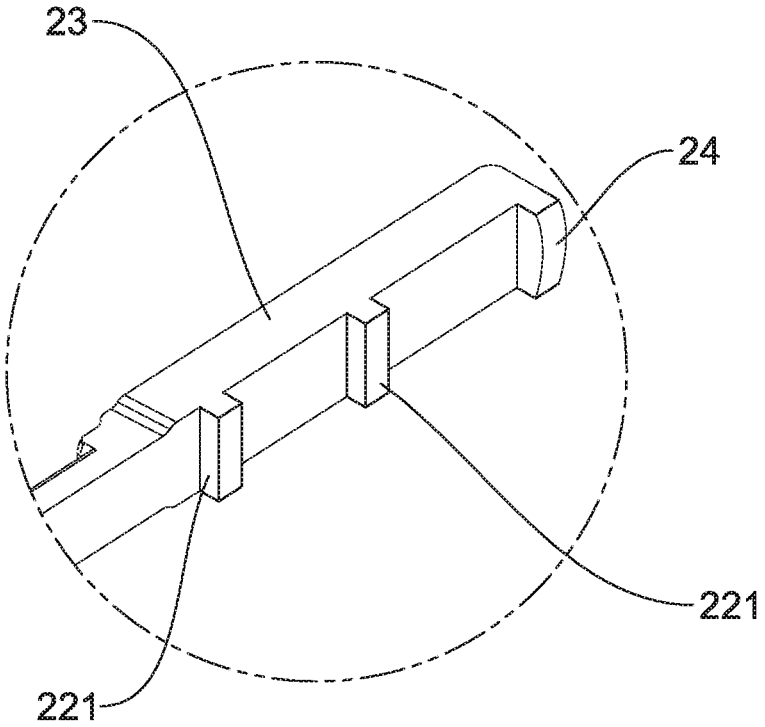
FIG. 3 is a perspective view of a portion A of FIG. 2.
Figure 4:
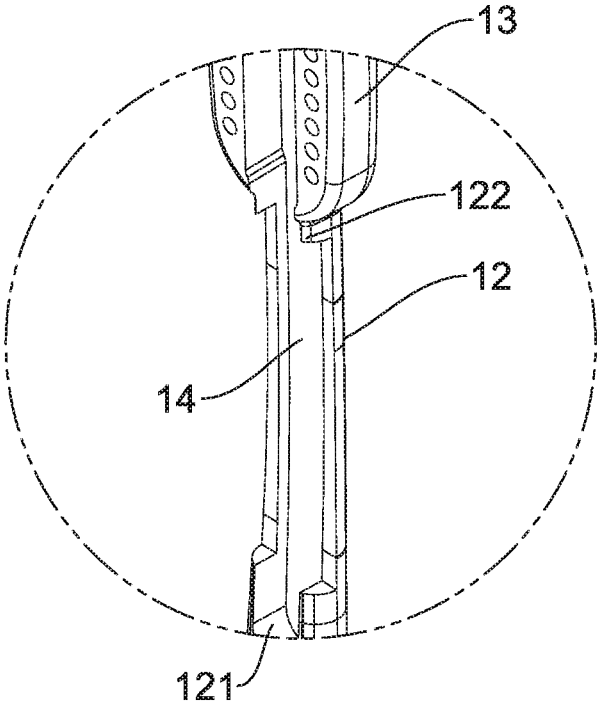
FIG. 4 is a perspective view of a portion B of FIG. 2.
Figure 5:
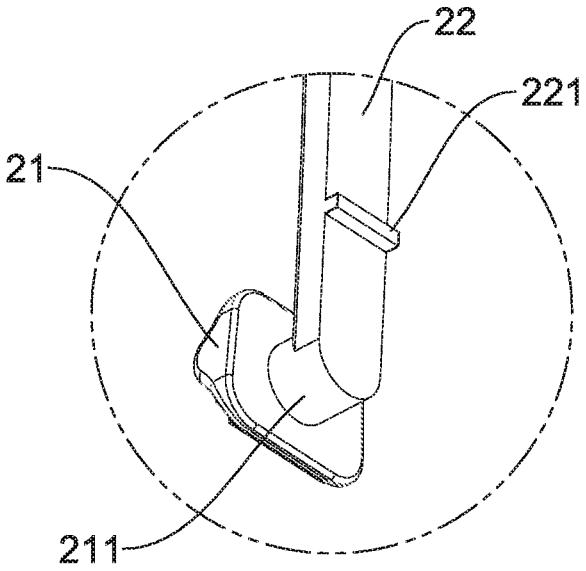
FIG. 5 is a perspective view of a portion C of FIG. 2.
Figure 6:
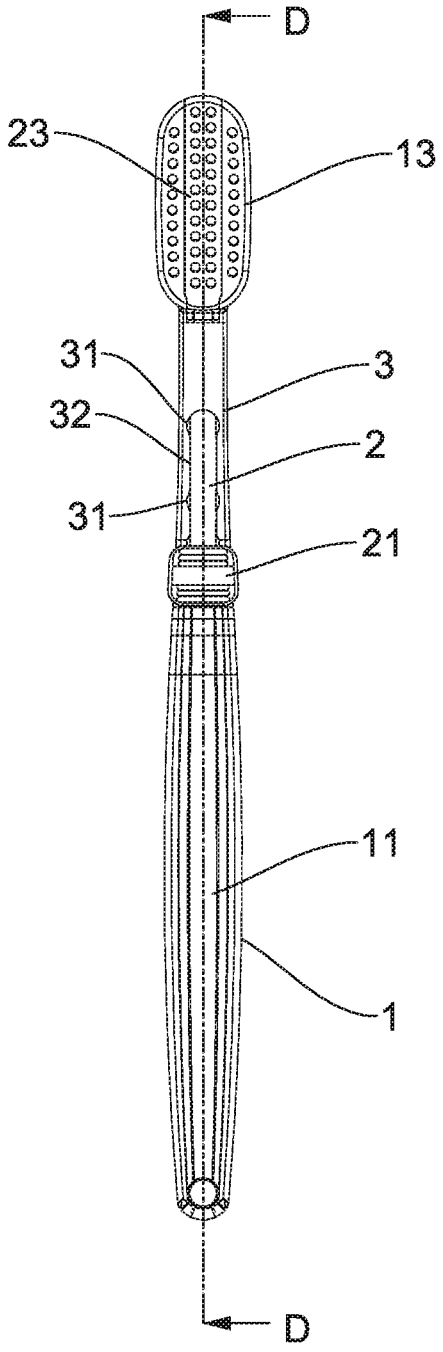
FIG. 6 is a side plan view showing the assembly of the toothbrush structure according to the preferred embodiment of the present invention.
Figure 7:
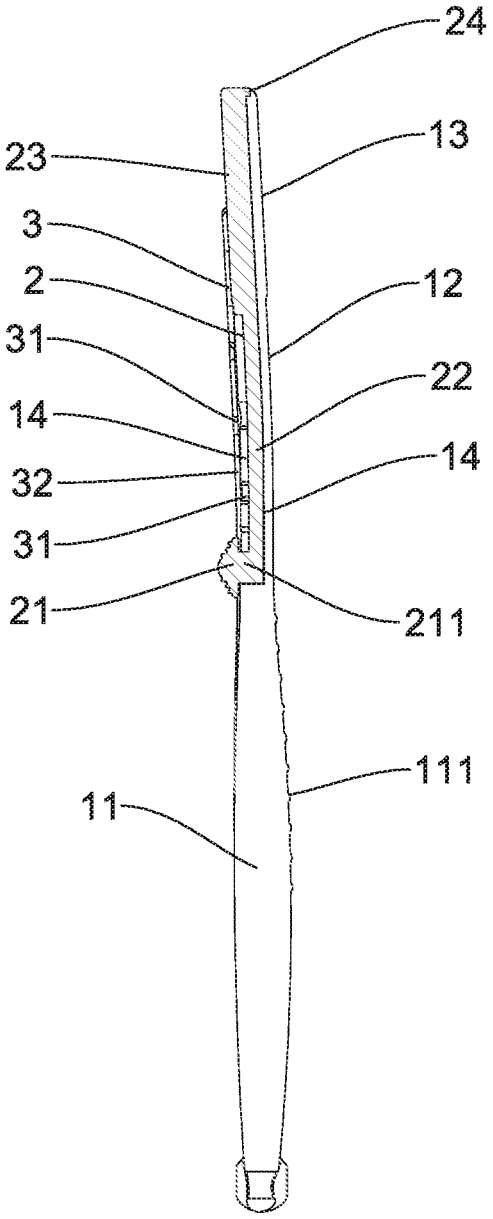
FIG. 7 is a cross sectional view taken along the line D-D of FIG. 6.
Figure 8:
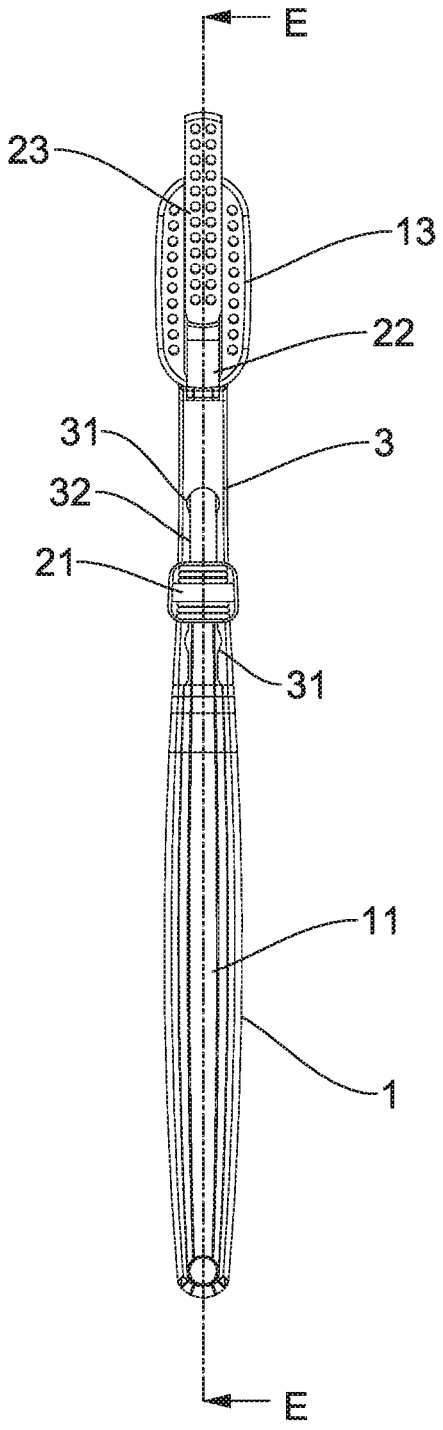
FIG. 8 is a side plan view showing the operation of the toothbrush structure according to the preferred embodiment of the present invention.
Figure 9:
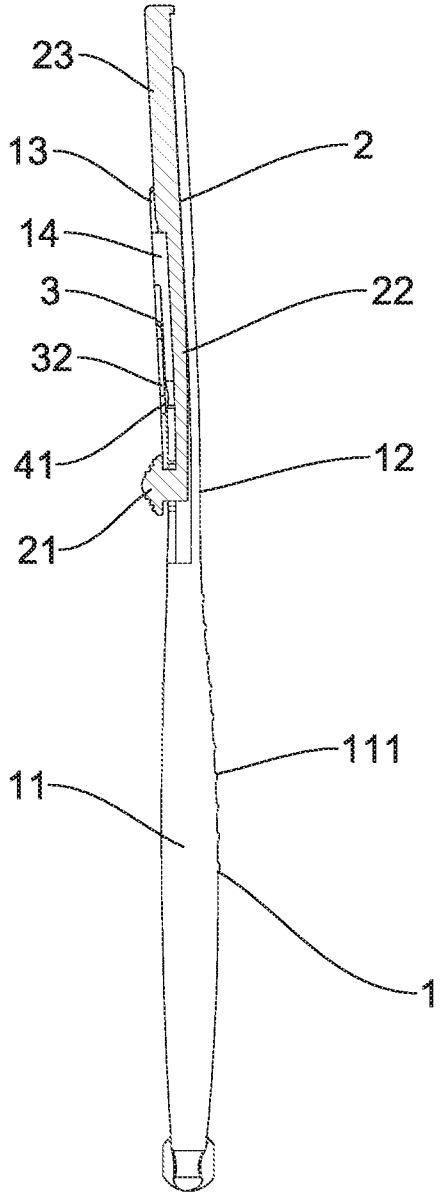
FIG. 9 is a cross sectional view taken along the line E-E of FIG. 8.

With reference to FIGS. 1 and 2, a toothbrush structure capable of expanding a cleaning depth according to a preferred embodiment of the present invention includes a body 1, a movable brush 2, and a protective unit 3.

Referring to FIGS. 1, 2, 6, and 8, the body 1 includes a handle 11, a connecting neck 12, and a fixed head 13, wherein the handle 11 is connected with the connecting neck 12 and is configured to be gripped by a user. The connecting neck 12 is connected with the handle 11 and the fixed head 13, the fixed head 13 has multiple first orifices for receiving multiple first bristles, and a slot 14 is formed on a middle portion of the fixed head 13 and extends to the handle 11. The handle 11 of the body 1 includes at least one anti-slip face 111 defined thereon. FIGS. 2 to 9 show a part of the toothbrush structure without the bristles.

As shown in FIGS. 1-9, the movable brush 2 is accommodated and slides in the slot 14 linearly, and the movable brush 2 includes a push block 21, a slidable post 22, and a movable brushing portion 23. The push block 21 is disposed on a top of a first end of the slidable post 22, the movable brushing portion 23 is mounted on a second end of the slidable post 22 opposite to the push block 21, and the movable brushing portion 23 has multiple second orifices for receiving multiple second bristles. The slidable post 22 is received in the slot 14 to slide the movable brushing portion 2 in the slot 14. To prolong a service life of the slidable post 22, the slidable post 22 has at least one reinforced rib 221 formed on a side surface thereof.

As illustrated in FIGS. 2-9, two ends of the connecting neck 12 have two stop faces 121, 122, such that the movable brush 2 is limited to slide in the slot 14. To stop the movable brush 2, the movable brush 2 includes an engagement tab 24 formed thereon opposite to the movable brushing portion 23 and configured to engage with the two stop faces 121, 122.

With reference to FIGS. 1, 2, 6, and 9, the protective unit 3 is configured to cover the slot 14 so that the movable brush 2 is limited to slide in the slot 14. As shown in FIGS. 1, 2, and 5-8, a connection portion 211 is defined between the push block 11 and the slidable post 22, and the protective unit 3 includes multiple positioning portions 31 and a guide groove 32, wherein the connection portion 211 slides in the guide groove 32 linearly and is positioned by the multiple positioning portions 31, such that the movable brush 2 is positioned by the multiple positioning portions 31 after extending out of the guide groove 32 in a predetermined distance.

The body 1 and the protective unit 3 are connected in a high-frequency treatment manner. In another embodiment, the body 1 and the protective unit 3 are connected by using an adhesive. Alternatively, the body 1 is connected with the protective unit 3 by way of a dovetail structure (not shown).

As illustrated in FIGS. 6-9, the push block 21 is pushed by the user to extend the movable brush 2 out of the body 1 so that the movable brushing portion 23 cleans an oral cavity and teeth of the user at any angles freely.

Figure 10:
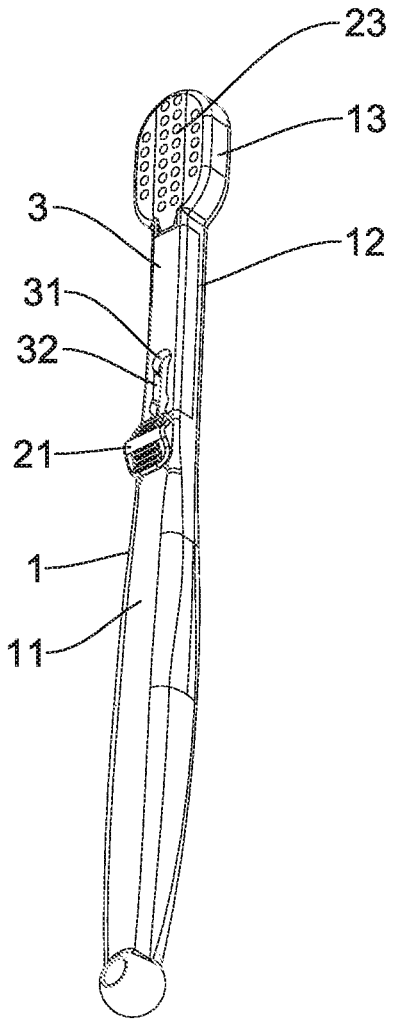
FIG. 10 is a perspective view showing the application of the toothbrush structure according to the preferred embodiment of the present invention.

FIGS. 1-9 show the toothbrush structure is applicable for an adult toothbrush. FIG. 10 shows the toothbrush structure is applicable for a children toothbrush.

While the preferred embodiments of the invention have been set forth for purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A toothbrush structure comprising: a body, a movable brush, and a protective unit;

the body including a handle, a connecting neck, and a fixed head, wherein the handle is connected with the connecting neck and is configured to be gripped by a user; the connecting neck is connected with the handle and the fixed head, the fixed head has multiple first orifices for receiving multiple first bristles, and a slot is formed on a middle portion of the fixed head and extends to the handle;

wherein the movable brush is accommodated and slides in the slot linearly, and the movable brush includes a push block, a slidable post, and a movable brushing portion, wherein the push block is disposed on a top of a first end of the slidable post, the movable brushing portion is mounted on a second end of the slidable post opposite to the push block, and the movable brushing portion has multiple second orifices for receiving multiple second bristles, the slidable post is received in the slot to slide the movable brushing portion in the slot;

wherein the protective unit is configured to cover the slot so that the movable brush is limited to slide in the slot, and wherein the slidable post has at least one reinforced rib formed on a side surface thereof.

2. The toothbrush structure as claimed in claim 1, wherein the handle of the body includes at least one anti-slip face defined thereon.

3. The toothbrush structure as claimed in claim 1, wherein two ends of the connecting neck have two stop faces, such that the movable brush is limited to slide in the slot.

4. The toothbrush structure as claimed in claim 3, wherein the movable brush includes an engagement tab formed thereon opposite to the movable brushing portion and configured to engage with the two stop faces.

5. The toothbrush structure as claimed in claim 3, wherein the movable brush includes an engagement tab formed thereon opposite to the movable brushing portion and configured to engage with the two stop faces.

6. The toothbrush structure as claimed in claim 1, wherein a connection portion is defined between the push block and the slidable post, and the protective unit includes multiple positioning portions and a guide groove, wherein the connection portion slides in the guide groove linearly and is positioned by the multiple positioning portions, such that the movable brush is positioned by the multiple positioning portions after extending out of the guide groove in a predetermined distance.

7. The toothbrush structure as claimed in claim 1, wherein the body and the protective unit are connected by using an adhesive.

8. The toothbrush structure as claimed in claim 1, wherein the body is connected with the protective unit by way of a dovetail structure.

* * * * *